US009341031B2

(12) United States Patent
Tan et al.

(10) Patent No.: US 9,341,031 B2
(45) Date of Patent: May 17, 2016

(54) RISER SUPPORT

(75) Inventors: Zhimin Tan, Katy, TX (US); Yanqiu Zhang, Houston, TX (US); Yucheng Hou, Katy, TX (US)

(73) Assignee: GE Oil & Gas UK Limited, Nailsea, Bristol (GB)

( * ) Notice: Subject to any disclaimer, the term of this patent is extended or adjusted under 35 U.S.C. 154(b) by 0 days.

(21) Appl. No.: 13/882,930

(22) PCT Filed: Oct. 25, 2011

(86) PCT No.: PCT/GB2011/052069

§ 371 (c)(1), (2), (4) Date: May 1, 2013

(87) PCT Pub. No.: WO2012/063035

PCT Pub. Date: May 18, 2012

(65) Prior Publication Data

US 2013/0216317 A1 Aug. 22, 2013

Related U.S. Application Data

(60) Provisional application No. 61/411,838, filed on Nov. 9, 2010.

(51) Int. Cl.
*E21B 17/01* (2006.01)

(52) U.S. Cl.
CPC ..... *E21B 17/01* (2013.01); *E21B 17/015* (2013.01)

(58) Field of Classification Search
CPC ..... E21B 17/01; E21B 17/012; E21B 17/015; E21B 17/017; E16L 1/24; E16L 1/18; E16L 1/14; E16L 1/20
USPC ..... 405/158, 168.1, 171–173, 224, 224.2, 405/224.3, 184.4; 166/350, 352, 367
See application file for complete search history.

(56) References Cited

U.S. PATENT DOCUMENTS

| | | | | |
|---|---|---|---|---|
| 4,065,822 | A * | 1/1978 | Wilbourn | 441/4 |
| 5,263,796 | A * | 11/1993 | de Waal | 405/172 |
| 7,287,936 | B2 * | 10/2007 | Streiff et al. | 405/224.2 |
| 2007/0081862 | A1 * | 4/2007 | Wolbers et al. | 405/169 |

FOREIGN PATENT DOCUMENTS

| | | |
|---|---|---|
| WO | 9507405 | 3/1995 |

OTHER PUBLICATIONS

International Preliminary Report on Patentability dated May 23, 2013, for corresponding International Application No. PCT/GB2011/052069, 8 pages.

International Search Report for corresponding PCT Application No. PCT/GB2011/052069, dated May 14, 2012 (2 pages).

* cited by examiner

*Primary Examiner* — Sean Andrish
*Assistant Examiner* — Patrick Lambe
(74) *Attorney, Agent, or Firm* — Shumaker & Sieffert, P.A.

(57) ABSTRACT

Apparatus and method for supporting a riser are disclosed. The apparatus includes an anchoring element (420) for anchoring a riser to a fixed structure, and a supporting portion (412) configured to support a section of flexible pipe (406), the supporting portion having a bearing surface for the section of flexible pipe to bear against to thereby restrain the flexible pipe from upward movement.

7 Claims, 5 Drawing Sheets

RISER SUPPORT

The present invention relates to a method and apparatus for supporting a riser, as well as a riser assembly itself. In particular, but not exclusively, the present invention relates to an apparatus suitable for use in the oil and gas industry, providing improved support to a riser that may experience severe environmental conditions.

Traditionally flexible pipe is utilised to transport production fluids, such as oil and/or gas and/or water, from one location to another. Flexible pipe is particularly useful in connecting a sub-sea location to a sea level location. Flexible pipe is generally formed as an assembly of a pipe body and one or more end fittings. The pipe body is typically formed as a composite of layered materials that form a pressure-containing conduit. The pipe structure allows large deflections without causing bending stresses that impair the pipe's functionality over its lifetime. The pipe body is generally built up as a composite structure including metallic and polymer layers.

In known flexible pipe design the pipe includes one or more tensile armour layers. The primary load on such a layer is tension. In high pressure applications, the tensile armour layer experiences high tension loads from the internal pressure end cap load as well as weight. This can cause failure in the flexible pipe since such conditions are experienced over prolonged periods of time.

One technique which has been attempted in the past to in some way alleviate the above-mentioned problem is the use of a mid-water arch structure to support a portion of the riser, by for example taking the weight of a middle portion of the riser. Examples of known configurations using a mid-water arch structure are shown in FIGS. 1*a* and 1*b*, which show the "steep S" configuration and "lazy S" configuration, respectively. In these configurations, there is provided a riser assembly 200 suitable for transporting production fluid such as oil and/or gas and/or water from a subsea location to a floating facility 202 such as a platform or buoy or ship. The riser is provided as a flexible riser, i.e., including a flexible pipe. The riser assembly 200 also includes a mid-water arch 208 resting on the seabed 204, for supporting a section of the riser by taking its weight. The riser is effectively draped over a curved surface of the mid-water arch. The riser may be clamped to the arch 208, so as to help avoid any movement of the riser which may be caused by water movement due to tides or moving vessels, or changing weight for example caused by marine growth (shellfish and other sea life and/or sea debris attaching to the riser). The positioning of the mid-water arch and flexible pipe can be arranged to give a steep S configuration $\mathbf{206}_1$ or a lazy S configuration $\mathbf{206}_2$.

However, these S configurations entail relatively higher installation costs and installation times compared to other techniques, such as the use of buoyancy aids. This is because the time and cost to install a mid-water arch structure is relatively higher.

Furthermore, from time to time, movement and/or buoyancy change of the riser can become strong enough to either enable the riser to slip from its position on the arch, or actually break the clamp holding the riser to the arch and allow the riser to lift up from the support of the mid-water arch structure. Without rapid attention, a riser that has broken free of a mid-water arch could cause major problems, including failure of the riser itself and associated problems.

It is an aim of the present invention to at least partly mitigate the above-mentioned problems.

It is an aim of embodiments of the present invention to provide a riser assembly and method of supporting a riser assembly that is more resilient to movement caused by tides, moving vessels, weight change and/or marine growth than known assemblies.

It is an aim of embodiments of the present invention to provide a riser assembly and method of supporting a riser assembly that is anchored to a fixed structure such as the sea bed and configured against the possibility of the riser lift-up problem discussed above.

According to a first aspect of the present invention there is provided apparatus for supporting a riser comprising at least one segment of flexible pipe, comprising: an anchoring element for anchoring a riser to a fixed structure; and a supporting portion configured to support a section of flexible pipe, the supporting portion having a bearing surface for the section of flexible pipe to bear against to thereby restrain the flexible pipe from upward movement.

According to a second aspect of the present invention there is provided a riser assembly for transporting fluids from a sub-sea location, comprising: a riser comprising at least one segment of flexible pipe; a support apparatus for supporting at least a portion of the flexible pipe, the support apparatus comprising a supporting portion having a bearing surface for the portion of flexible pipe to bear against to thereby restrain the flexible pipe from upward movement; and at least one buoyancy element for providing buoyancy to a portion of the riser.

According to a third aspect of the present invention there is provided a method of supporting a flexible pipe, the method comprising the steps of: providing a riser comprising at least one segment of flexible pipe; providing a support apparatus for supporting at least a portion of the riser, the support apparatus comprising a supporting portion having a bearing surface for the portion of flexible pipe to bear against to thereby restrain the flexible pipe from upward movement; and providing at least one buoyancy element for providing buoyancy to a portion of the riser.

Certain embodiments of the invention provide the advantage that a riser is suitably anchored to help avoid problems associated with movement of the riser, whilst having a configuration that will prevent the aforementioned riser lift-up problem. The whole or part of the supporting portion body is positioned above the riser, so as to act as a solid barrier to prevent the riser from moving upwards towards the surface. Additional use of buoyancy modules along the riser, at the sides of the support apparatus, can ensure that a sufficient portion of the riser weight is supported, to help avoid high tension loading on the riser, and also help configure the riser to a formation where it can be located beneath or through the supporting portion.

Certain embodiments of the invention provide the advantage that the bearing surface of the supporting portion can also act as a bend limiter, allowing only a predetermined degree of curvature in the riser, so as to help prevent damage to the riser.

Certain embodiments of the invention provide the advantage that a mid-water arch structure is provided with improved lifetime and overall performance compared to known apparatus.

BRIEF DESCRIPTION OF THE DRAWINGS

Embodiments of the invention are further described hereinafter with reference to the accompanying drawings, in which.

DETAILED DESCRIPTION

Figure 1A:
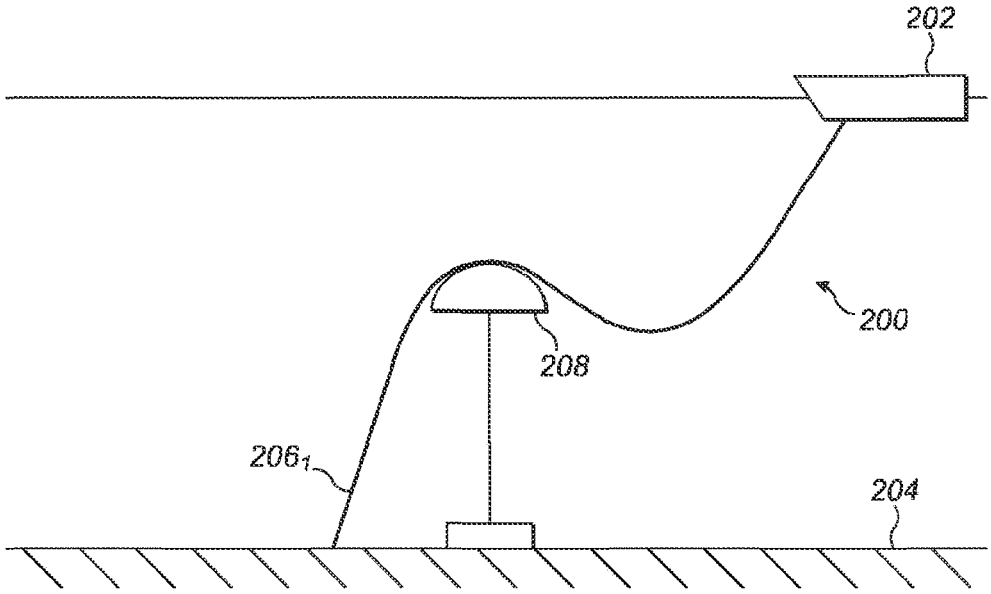
FIG. 1a Prior Art
FIG. 1*a* illustrates a known riser assembly.
Figure 1B:
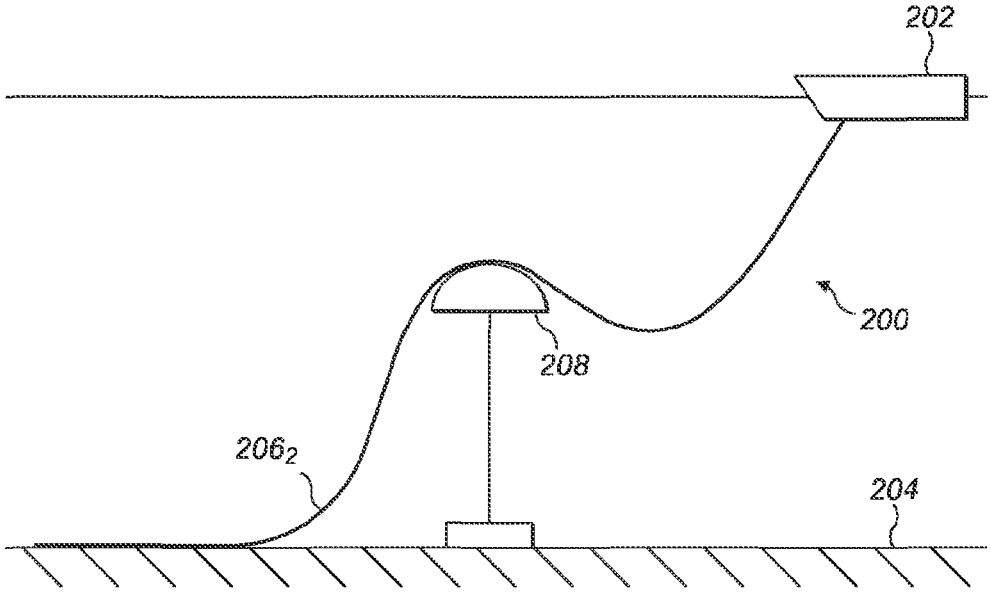
FIG. 1b Prior Art
FIG. 1*b* illustrates another known riser assembly.

In the drawings like reference numerals refer to like parts.

Figure 2:
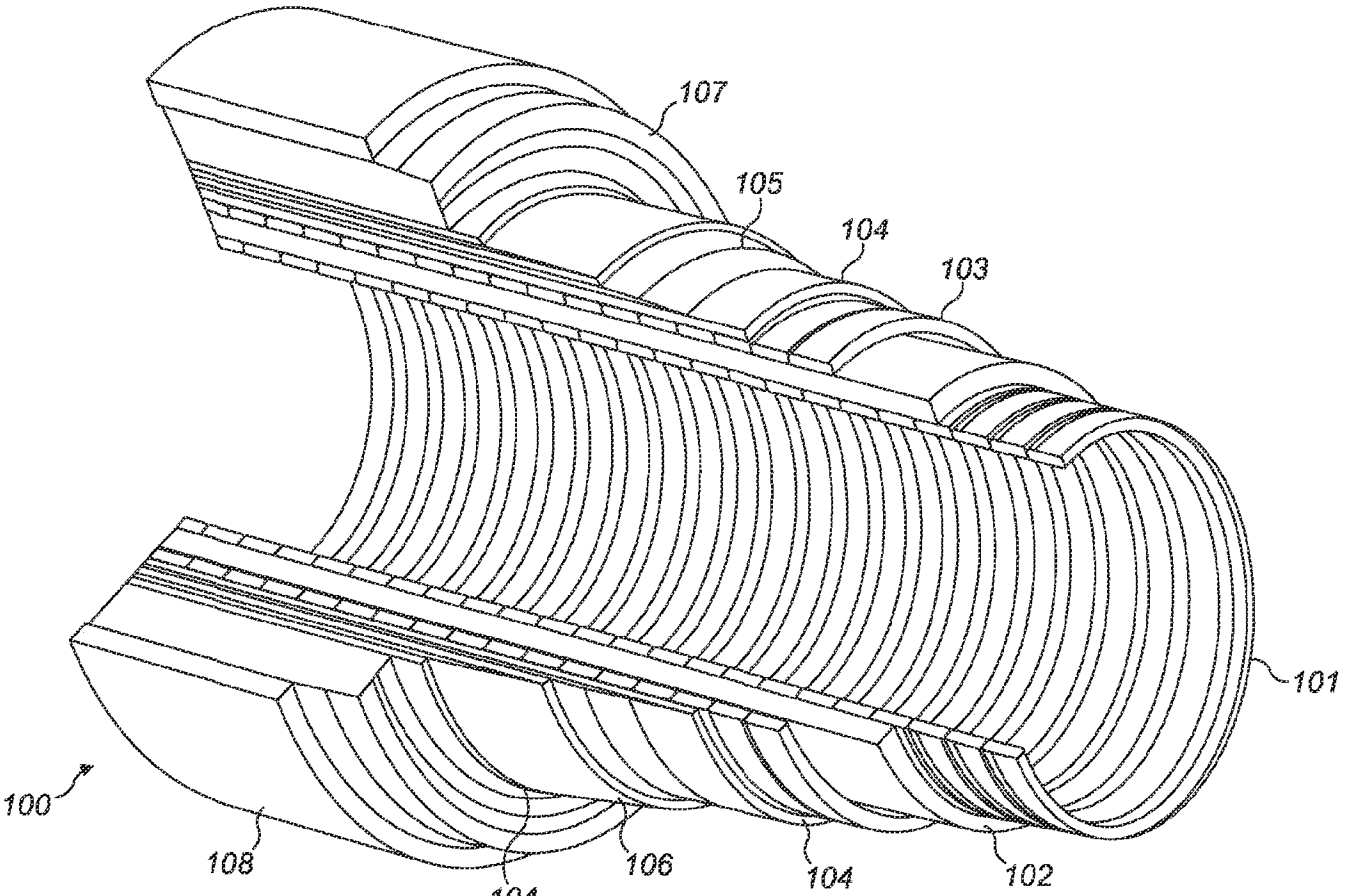
FIG. 2 illustrates a flexible pipe body.

Throughout this description, reference will be made to a flexible pipe. It will be understood that a flexible pipe is an assembly of a portion of a pipe body and one or more end fittings in each of which a respective end of the pipe body is terminated. FIG. 2 illustrates how pipe body 100 is formed in accordance with an embodiment of the present invention from a composite of layered materials that form a pressure-containing conduit. Although a number of particular layers are illustrated in FIG. 2, it is to be understood that the present invention is broadly applicable to composite pipe body structures including two or more layers manufactured from a variety of possible materials. It is to be further noted that the layer thicknesses are shown for illustrative purposes only.

As illustrated in FIG. 2, a pipe body includes an optional innermost carcass layer 101. The carcass provides an interlocked construction that can be used as the innermost layer to prevent, totally or partially, collapse of an internal pressure sheath 102 due to pipe decompression, external pressure, and tensile armour pressure and mechanical crushing loads. It will be appreciated that certain embodiments of the present invention are applicable to 'smooth bore' as well as such 'rough bore' applications.

The internal pressure sheath 102 acts as a fluid retaining layer and comprises a polymer layer that ensures internal-fluid integrity. It is to be understood that this layer may itself comprise a number of sub-layers. It will be appreciated that when the optional carcass layer is utilised the internal pressure sheath is often referred to by those skilled in the art as a barrier layer. In operation without such a carcass (so-called smooth-bore operation) the internal pressure sheath may be referred to as a liner.

An optional pressure armour layer 103 is a structural layer with a lay angle close to 90° that increases the resistance of the flexible pipe to internal and external pressure and mechanical crushing loads. The layer also structurally supports the internal-pressure sheath.

The flexible pipe body also includes an optional first tensile armour layer 105 and optional second tensile armour layer 106. Each tensile armour layer is a structural layer with a lay angle typically between 20° and 55°. Each layer is used to sustain tensile loads and internal pressure. The tensile armour layers are typically counter-wound in pairs.

The flexible pipe body shown also includes optional layers 104 of tape which help contain underlying layers and to some extent prevent abrasion between adjacent layers.

The flexible pipe body also typically includes optional layers of insulation 107 and an outer sheath 108 which comprises a polymer layer used to protect the pipe against penetration of seawater and other external environments, corrosion, abrasion and mechanical damage.

Each flexible pipe comprises at least one portion, sometimes referred to as a segment or section of pipe body 100 together with an end fitting located at at least one end of the flexible pipe. An end fitting provides a mechanical device which forms the transition between the flexible pipe body and a connector. The different pipe layers as shown, for example, in FIG. 2 are terminated in the end fitting in such a way as to transfer the load between the flexible pipe and the connector.

Figure 3:
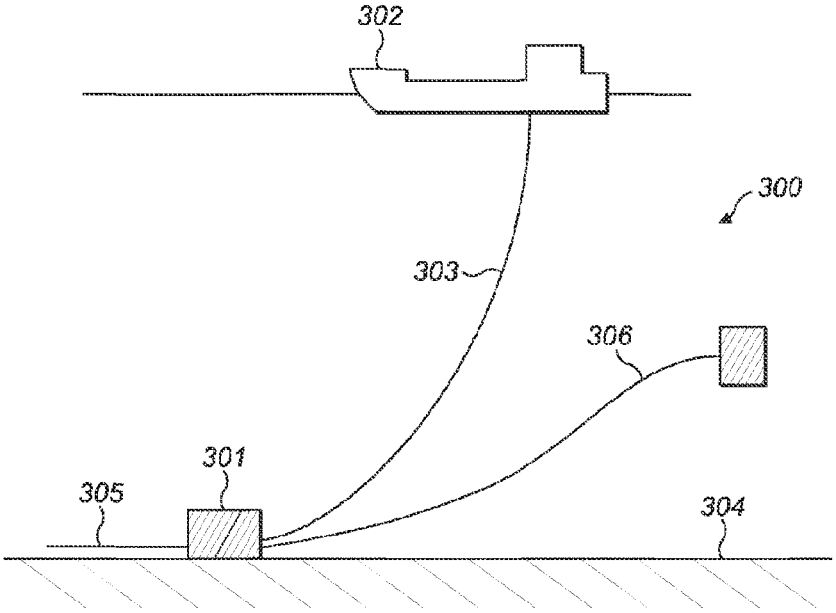
FIG. 3 illustrates another riser assembly.

FIG. 3 illustrates a riser assembly 300 suitable for transporting production fluid such as oil and/or gas and/or water from a sub-sea location 301 to a floating facility 302. For example, in FIG. 3 the sub-sea location 301 includes a sub-sea flow line. The flexible flow line 305 comprises a flexible pipe, wholly or in part, resting on the sea floor 304 or buried below the sea floor and used in a static application. The floating facility may be provided by a platform and/or buoy or, as illustrated in FIG. 3, a ship. The riser 300 is provided as a flexible riser, that is to say a flexible pipe connecting the ship to the sea floor installation.

It will be appreciated that there are different types of riser, as is well-known by those skilled in the art. Embodiments of the present invention may be used with any type of riser, such as a freely suspended (free, catenary riser), a riser restrained to some extent (buoys, chains), totally restrained riser or enclosed in a tube (I or J tubes).

FIG. 3 also illustrates how portions of flexible pipe body can be utilised as a flow line 305 or jumper 306.

Figure 4:
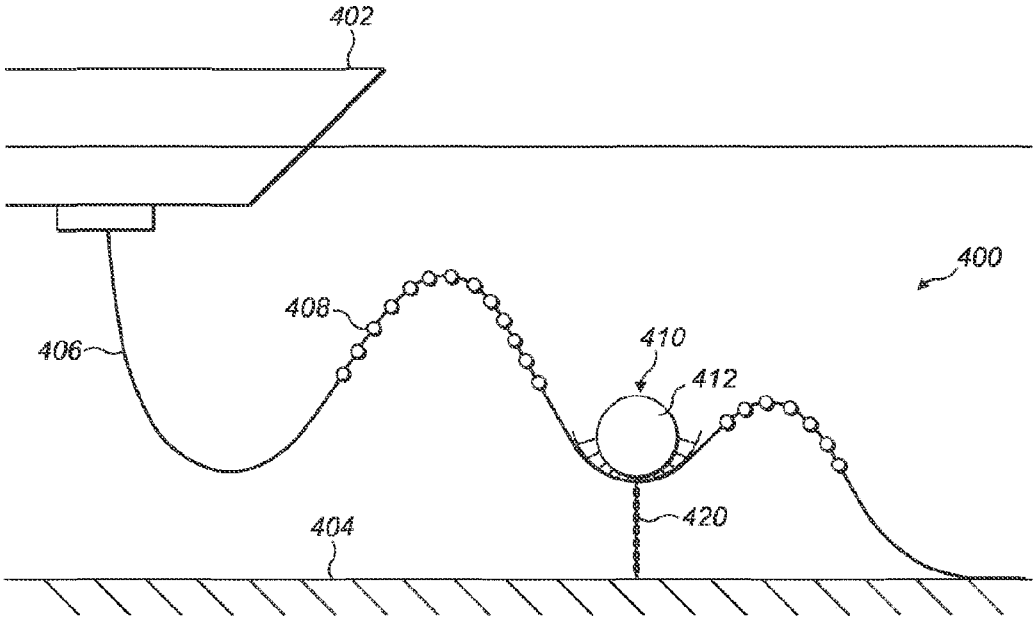
FIG. 4 illustrates a support apparatus of the present invention.

FIG. 4 illustrates a riser support apparatus 410 of the present invention. It is noted that the riser support apparatus of the invention may alternatively be referred to as a mid-water arch structure throughout the specification (due to its development from a traditional mid-water arch structure). The riser support apparatus 410 is shown in use, as part of a riser assembly 400, supporting a riser 406, which may be comprised of at least one segment of flexible pipe, i.e., one or more sections of flexible pipe body, and one or more end fittings in each of which a respective end of the pipe body is terminated. The riser 406 extends from a floating production storage and offloading unit (FPSO) 402 to the seabed 404. The riser assembly 400 also includes several buoyancy modules 408. In the example shown in FIG. 4, twenty buoyancy modules are shown. Of course it will be clear that fewer or more buoyancy modules may be employed to suit the requirements of the specific situation.

Figure 5:
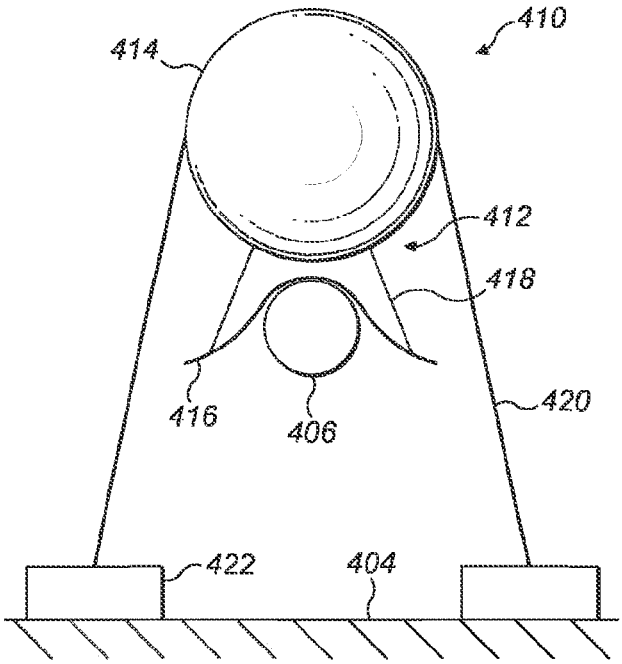
FIG. 5 illustrates another view of the support apparatus of the present invention.
Figure 6:
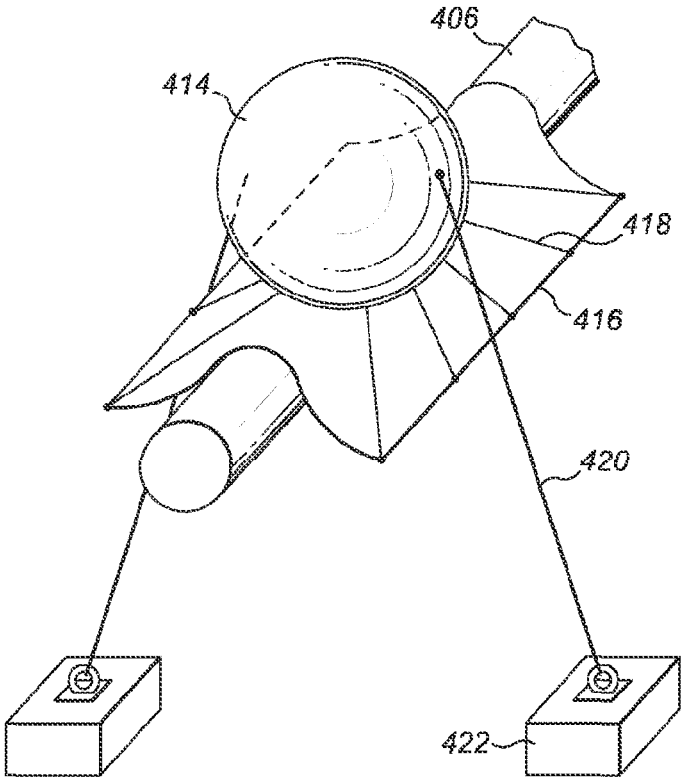
FIG. 6 illustrates yet another view of the support apparatus of the present invention.

The apparatus 410 of the present embodiment is illustrated in FIG. 5, the cross-sectional view being in a plane 90 degrees to the view shown in FIG. 4. FIG. 6 shows a perspective view of the apparatus 410 with a portion of flexible pipe seated below the apparatus.

As can be seen in FIGS. 4 to 6, the apparatus 410 is made up of a main body 412 (supporting portion) which includes a positively buoyant buoyancy element 414 and a saddle element 416 connected to the buoyancy element 414. The saddle element acts to at least partly surround the flexible pipe of the riser 406. In this embodiment, the saddle element 416 is a sheet steel formation connected to the buoyancy element 414 by steel rods 418. The saddle element 416 provides a bearing surface for a portion (an upper portion) of the flexible pipe to bear against. The saddle element 416 is inversely mounted on the buoyancy module 414 compared to known mid-water arch structures. The apparatus 410 also includes an anchoring element 420, which in this embodiment is a chain for tethering the buoyancy element 414 to an anchor weight 422 located on the seabed 404. In other embodiments of the invention, the anchoring element could be non-flexible, for example a structure of metal. Alternatively the anchoring element could be rope or other such tether or restraining aid, or some combination thereof. The main body could take many forms, provided a bearing surface is provided to seat the flexible pipe against.

Such a configuration effectively anchors a portion of the riser in a predetermined position. The main body of the apparatus 410 is positioned above the portion of flexible pipe that it contacts. The flexible pipe is anchored so as to prevent the pipe from being able to break free and rise upwards in severe environmental conditions.

Figure 7:
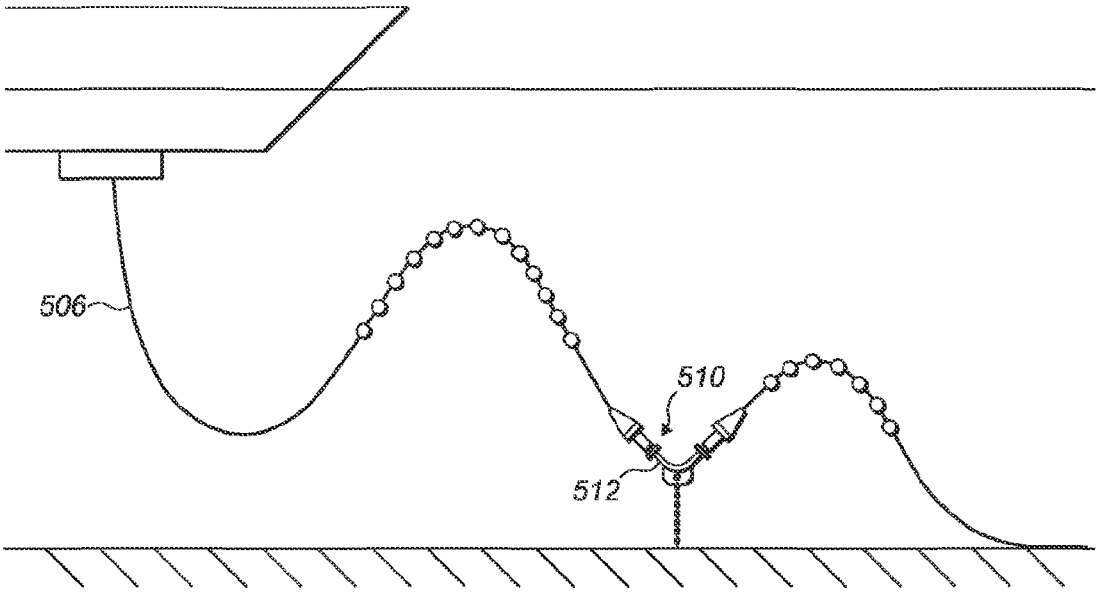
FIG. 7 illustrates another support apparatus of the present invention.
Figure 8:
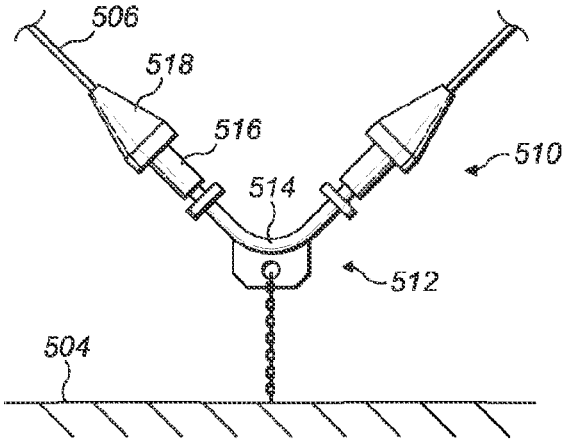
FIG. 8 illustrates an enlarged view of the support apparatus of FIG. 7.

A further embodiment of the apparatus of the present invention is illustrated in FIG. 7, and shown in an enlarged view in FIG. 8. Apparatus 510 is made up of a main body 512, which includes a substantially V-shaped body formed of a central spool work 514 which is connected at each end thereof to an end fitting 516. Sections of flexible pipe of the riser 506 join with end fittings 516 in a known manner. Each end fitting 516 is connected to a bend stiffener 518, so as to gradually stiffen the flexible pipe to match the rigidity of the end fitting. The main body 512 is connected to an anchoring element, which in this embodiment is a chain for tethering the apparatus to the sea bed 504 (via an anchor weight, or the like).

This configuration effectively anchors a portion of the riser in a predetermined position. The flexible pipe is joined to the apparatus 510 securely to prevent the pipe from being able to break free and rise upwards in severe environmental conditions.

As with the first embodiment, the anchoring element could be non-flexible, and the main body could take other forms, providing a bearing surface to at least partly surround the flexible pipe and prevent the flexible pipe from rising upward.

As shown in both embodiments described above, the mid-water arch structure of the present invention is provided in a riser assembly with buoyancy modules at either side thereof. The buoyancy modules are attached or integrally formed with the riser in a known manner. The buoyancy modules act to take the weight of the riser and reduce the tension loading. Providing buoyancy modules at either side of the mid-water arch structure, as shown in FIGS. 4 and 7, also helps to configure the riser into the approximate U-shape or V-shape so that the necessary portion of the flexible pipe can be seated or attached to the mid-water arch assembly.

In shallow water applications (less than 1000 feet/304.8 meters), buoyancy modules can be particularly sensitive to variation in riser weight caused by marine growth, loss of buoyancy due to movement or general wear, etc. In such circumstance a buoyancy module could divert completely from its original position and pop up on the water's surface or sink to the seabed. This can also lead to interference with neighbouring risers or vessels. However, by using the mid-water arch structure of the present invention, a section of the riser is securely anchored at a predetermined position to prevent such lateral or vertical movement.

In another embodiment of the invention, the buoyancy modules could be provided to be positively buoyant, i.e., having sufficient buoyancy that the buoyancy modules tend to rise upwards towards the surface. The mid-water arch structure provides an opposite force, by restraining such movement. Thereby, the anchoring elements are in constant tension, and the height above the seabed of the buoyancy elements and the riser assembly is generally fixed.

It will be appreciated that the mid-water arch structure can be formed according to the requirements of the specific situation. In general, an approximate U-shape or V-shape may be formed. The apparatus can be designed to act as a bend limiter, i.e., having a bearing surface constructed to prevent the riser from bending more than a predetermined radius of curvature. The mid-water arch structure of the present invention will cause flexible pipe of the riser to generally exit the bearing surface at an upward angle or pathway.

Figure 9:
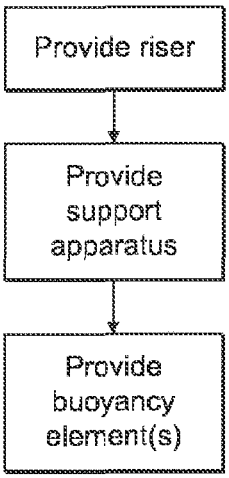
FIG. 9 illustrates a flow chart showing a method of the present invention.

A method of supporting a flexible pipe of the present invention includes providing a riser comprising at least one segment of flexible pipe, providing a support apparatus for supporting at least a portion of the riser, the support apparatus comprising a supporting portion having a bearing surface for the portion of flexible pipe to bear against to thereby restrain the flexible pipe from upward movement; and providing at least one buoyancy element for providing buoyancy to a portion of the riser, for example as schematically shown in the flow chart of FIG. 9. The steps need not be performed in the order described.

With the invention described above, enhanced support is provided to the riser to help prevent unwanted movement of the riser after installation. This may be particularly useful in harsh environmental conditions. In addition, the apparatus is securely anchored to a fixed structure, yet configured to prevent the chance of the riser breaking free of the mid-water arch and lifting upwards away from the mid-water arch.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A riser assembly for transporting fluids from a sub-sea location comprising:

a riser comprising at least one segment of flexible pipe, and apparatus for supporting the riser in a mid-water position, the apparatus comprising:

an anchoring element for anchoring a supporting portion to a fixed structure, the supporting portion comprising:

a positively buoyant element connected to the anchoring element and retained by the anchoring element in a mid-water position between the fixed structure and sea-level, and a saddle element on an underside of the positively buoyant element and between the positively buoyant element and the fixed structure, wherein the saddle element comprises a curved sheet-like member, an underside of the sheet-like member comprising a substantially U-shaped or substantially V-shaped bearing surface for the section of flexible pipe to bear against to thereby restrain the flexible pipe from upward movement, and wherein the section of flexible pipe bears against the bearing surface, wherein the bearing surface has a substantially U-shaped or substantially V-shaped configuration in a longitudinal direction with respect to the flexible pipe such that the flexible pipe exits the bearing surface at an upward angle at each side of the supporting portion and such that the flexible pipe is supported in a substantially U-shaped or substantially V-shaped configuration by the bearing surface.

2. The riser assembly as claimed in claim 1, wherein the anchoring element is at least partly flexible.

3. The riser assembly as claimed in claim 1, comprising an arrangement of rods between the positively buoyant element and a surface of the curved sheet opposite the bearing surface thereof.

4. The riser assembly as claimed in claim 1, wherein the riser further comprises at least one buoyancy module.

5. The riser assembly as claimed in claim 4, wherein the riser comprises a first arrangement of buoyancy modules on a first side of the supporting portion, and a second arrangement of buoyancy modules on a second side of the supporting portion opposite the first side thereof.

6. A method of supporting a riser comprising at least one segment of flexible pipe in a mid-water position, the method comprising:

anchoring a positively buoyant element mid-way between a fixed structure and a sea-level location, wherein the positively buoyant element comprises a saddle element on an underside thereof and between the positively buoyant element and the fixed structure, wherein the saddle element comprises a curved sheet-like member;

supporting the flexible pipe in the curved sheet-like member, wherein an underside of the curved sheet-like member comprises a substantially U-shaped or substantially V-shaped bearing surface for the section of flexible pipe to bear against to restrain the flexible pipe from upward movement, and wherein the flexible pipe bears against the bearing surface, wherein the bearing surface has a substantially U-shaped or substantially V-shaped configuration in a longitudinal direction with respect to the flexible pipe such that the flexible pipe is supported in a substantially U-shaped or V-shaped configuration by the bearing surface and such that the flexible pipe exits the bearing surface at an upward angle at each side of the positively buoyant element.

7. The method as claimed in claim 6, further comprising providing at least one buoyancy module at each side of the positively buoyant element.

* * * * *